US010111544B1

(12) United States Patent
Bernstein et al.

(10) Patent No.: US 10,111,544 B1
(45) Date of Patent: Oct. 30, 2018

(54) HANGER AND HOOK ATTACHMENT

(71) Applicant: SJBEE LLC, Hewlett, NY (US)

(72) Inventors: Steven J. Bernstein, Hewlett, NY (US); Leslie S. Blitz, New Hyde Park, NY (US)

(73) Assignee: SJBee LLC, Hewlett, NY (US)

( * ) Notice: Subject to any disclaimer, the term of this patent is extended or adjusted under 35 U.S.C. 154(b) by 0 days.

(21) Appl. No.: 15/422,168

(22) Filed: Feb. 1, 2017

Related U.S. Application Data

(60) Provisional application No. 62/293,917, filed on Feb. 11, 2016.

(51) Int. Cl.
*A47G 25/32* (2006.01)
*A47G 25/40* (2006.01)
*A47G 25/38* (2006.01)

(52) U.S. Cl.
CPC ..... *A47G 25/32* (2013.01); *A47G 25/38* (2013.01); *A47G 25/40* (2013.01)

(58) Field of Classification Search
CPC ..... A47G 25/32; A47G 25/40; A47G 25/02; A47G 25/06; A47G 25/14; A47G 25/16; A47G 25/20; A47G 25/22; A47G 25/26; A47G 25/28; A47G 25/30; A47G 25/34; A47G 25/38; A47G 25/44; A47G 25/48; A47G 25/0614; A47G 25/065; A47G 25/0678; A47G 25/0685; A47G 25/183; A47G 25/186; A47G 25/4015–25/4069; A47G 25/441–25/447
See application file for complete search history.

(56) References Cited

U.S. PATENT DOCUMENTS

| | | | | |
|---|---|---|---|---|
| 3,790,046 | A * | 2/1974 | Rooney | A47G 25/32 223/92 |
| 4,487,343 | A * | 12/1984 | Chen | A47G 25/32 223/85 |
| 5,183,190 | A * | 2/1993 | Zuckerman | A47G 25/32 223/89 |
| 7,837,074 | B2 | 11/2010 | Rude et al. | |
| 8,113,393 | B2 | 2/2012 | Ho | |
| 8,381,952 | B2 * | 2/2013 | Mainetti | A47G 25/32 223/85 |
| 8,899,454 | B2 * | 12/2014 | Mainetti | A47G 25/32 223/85 |
| 2004/0211796 | A1 * | 10/2004 | Misumi | A47G 25/1435 223/85 |
| 2011/0031286 | A1 * | 2/2011 | Gouldson | A47G 25/16 223/88 |
| 2011/0073624 | A1 * | 3/2011 | Blanchard | A47G 25/32 223/85 |
| 2013/0200113 | A1 * | 8/2013 | Tashkin | A47G 25/32 223/85 |

* cited by examiner

*Primary Examiner* — Ismael Izaguirre
(74) *Attorney, Agent, or Firm* — Levisohn Berger LLP

(57) ABSTRACT

A garment hanger with a hook either metal or plastic that moves between a substantially vertical position and a substantially horizontal position. The body of the hanger having mounts that allow for the attachment of an assembly containing a hanger hook which allows hook movement either vertical or horizontal to help in footprint reduction of hanger creating space savings in packaging and transport. A size indicator has been developed to fit over this hook assembly and still allow the folding of the hook.

5 Claims, 8 Drawing Sheets

HANGER AND HOOK ATTACHMENT

RELATED APPLICATION

This application claims the priority of U.S. Provisional Patent Application Ser. No. 62/293,917, filed Feb. 11, 2016, the invention of which is incorporated herein.

BACKGROUND OF THE INVENTION

Garment hangers have been around for hundreds of years. Modern day retail use garment hangers have many packaging and travel requirements and specifications intended to increase efficiency in the supplier to retailer pipeline by minimizing order to sales floor or e commerce shipment time. Many garments are manufactured all over the world and then shipped to United States (or other countries) prehung as a "garment on hanger" from the originating garment manufacturing location. In order to save time and expense at the retail level the garment is placed on the hanger at the point of garment manufacturing and placed into a shipping box or container. Upon delivery to the retailer location, the retailer has to remove the garment on hanger from the box or container and hang appropriately in distribution center for e commerce shipment or further shipment to an individual store.

Present day Omni Channel process dictates whether the garment will go directly to a sales floor or be shipped in ecommerce packaging. Since the retailer or the garment manufacturer does not always know which apparel will go to the greater need, either brick and mortar store or ecommerce, the need for a garment hanger that can be used in both channels without being changed is required.

This invention relates to the need for an individual hanger to be able to be used both at retail level and ecommerce shipments due to the nature of the folding hook.

Today's dimensional packaging shipping costs have made for the appreciation of smaller shipping boxes saving cost based on the dimension of the box.

A prior art patent to Ho, U.S. Pat. No. 8,113,393, describes a collapsible hook hanger in which hook 18 has its end 32 threaded into aperture 34. The drum rotates in opening 30 to allow the hook to be moved between vertical and horizontal positions.

The hanger of Ho is generally plastic, and the movement of hook 18 between vertical and horizontal positions is achieved through removing ribs 38*a, b, c* and *d* from detents 36.

As described in the Ho patent, it is necessary to physically pull the hook 18 and the drum out from connection between ribs 38 and the detents 36. This is described in column 3, lines 19-26. The direction of separating the ribs from the detents is perpendicular to the plane of movement of hook 18. This makes separation difficult without using serious force.

Applying pressure between the ribs and detents in a plastic hanger presents certain structural issues especially since such hangers can be easily broken or fractured.

An object of this invention is to provide a hanger with a hook movable between vertical and horizontal positions which is sturdy, susceptible of longstanding and continued use.

Another object of this invention is to provide such a hanger with a movable hook in which the hanger body is made of plastic, is susceptible of multiple uses and reuses of the movable hook without fracturing the plastic of the hanger body.

Yet another object of this invention is to provide a hanger with a movable hook in which the movement between relative positions is easy to obtain, structurally strong and capable of widespread use.

Another object of this invention is to provide a sizer tab which fits into the hanger body such that the sizer tab is not susceptible of easy removal.

Other objects, advantages and features of this invention will become more apparent from the following description.

DESCRIPTION OF THE INVENTION

In accordance with the principles of this invention, the above objects are met by providing a hanger with a movable hook in which the movable hook threads into a hook attachment formed of a substantially sturdy, compact and structurally strong partial trapezoidal structure, further in which the hook attachment is pivotably connected to the hanger body at a pivot point and is independently held in the horizontal position by a flexible finger member bearing against a portion of the hook attachment assembly. Such a barrier to unwanted movement of the hook when in the vertical position is substantially more sturdy and less susceptible to breakage or damage during repeated use of the hanger of this invention. Further, the hook moves in the same plane as the engaging locking members that hold the hanger in the vertical position. The torque obtained by moving the hook allows less force to be required to engage and disengage the hook enabling its movement.

DETAILED DESCRIPTION OF THE INVENTION

Figure 1:
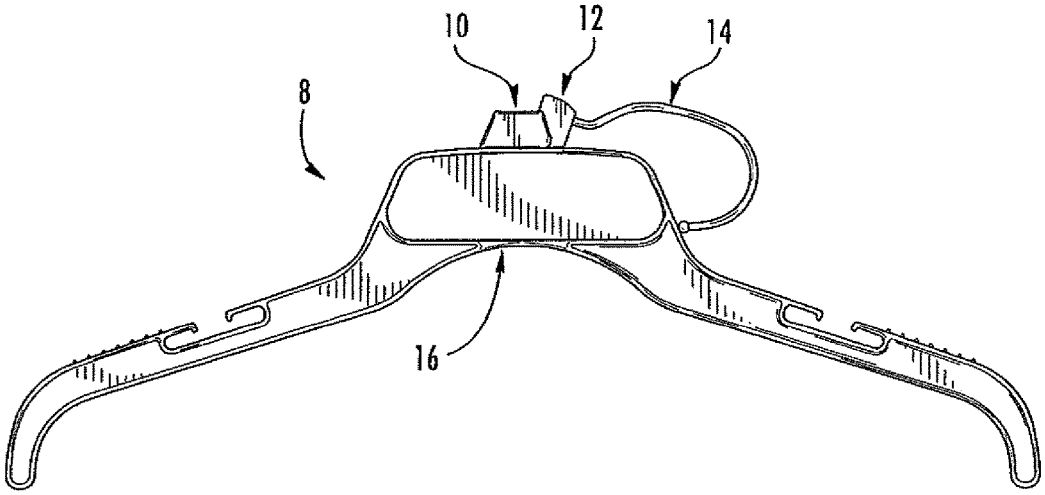
FIG. 1 is a rear plan view of the hanger and hook of this invention.

Referring to FIG. 1, hanger 8 has the body of an I-beam construction hanger formed in accordance with the present invention showing a full hanger with hook 14 in the folded (horizontal) position and hook attachment 12 attached to hanger body 16.

Size identity tab 10 is also shown in this completed hanger version. In one preferred embodiment, hanger 8 could include a coordinate loop (not shown here) for receiving a second hanger or be an entirely different shaped garment hanger.

Hanger 8 is an example of most commonly used top hanger silhouette, but this invention is not limited to only top hangers. Hanger 8 includes a metal hook 14 shown in a folded position or can also have a plastic hook in place of the metal hook. More particularly, hook 14 is rotatable between the vertical and horizontal positions shown in FIG. 1 in the folded (horizontal) position and in FIG. 5A in the upright (vertical) position.

When hook 14 is pivoted into the upright (vertical) position, hanger 8 functions as a conventional garment hanger for supporting and displaying a garment. However, during transportation hook 14 can be folded into the horizontal position to reduce the footprint of the hanger and the overall shipping box into which the garments, and/or hangers can be packed. The reduction of size of the carton reduced dimensional packaging and shipping costs.

Figure 2:
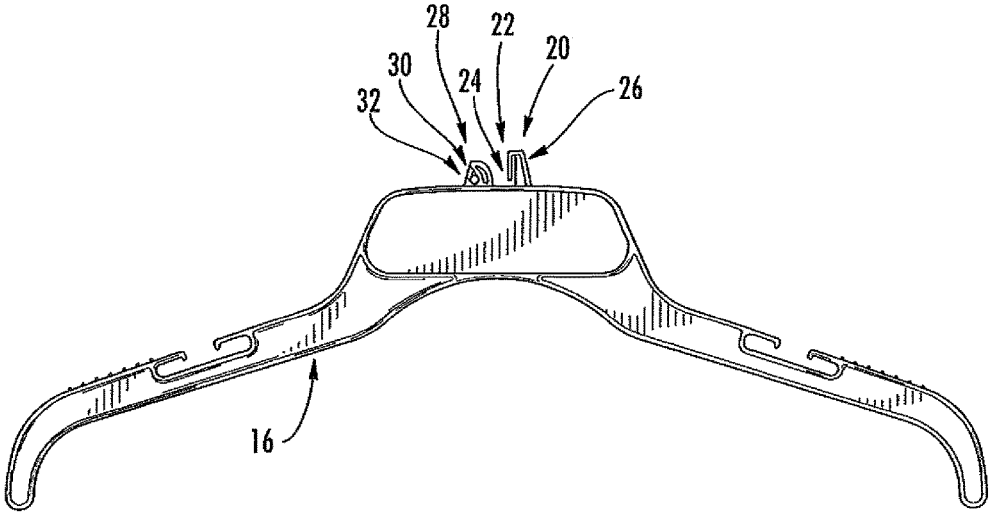
FIG. 2 is a front plan view of the hanger body of this invention.
Figure 3A:
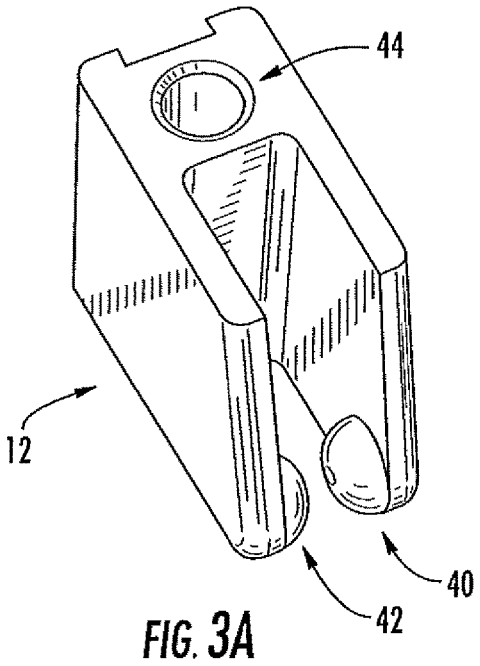
FIG. 3A is a perspective view of the hook attachment of this invention.
Figure 3B:
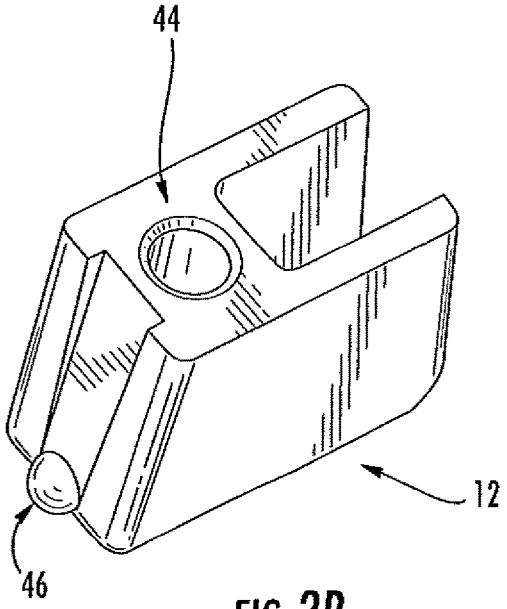
FIG. 3B is a perspective view of the hook attachment of this invention showing the front locking nub.

FIG. 2 shows a hanger body with two independent attaching and locking protrusions—locking mount 20 and pivot mount 28 integrally formed on top of the hanger body 16. The top portion of hanger 16 has locking mount 20 attached thereto which includes flexible finger member 22. Flexible finger member 22 is set at angle to make it easier to engage and hold locking lug 46 (see FIG. 3B). Locking mount 20 has a sizer tab receiver 26 over which fits sizer tab 10. Locking nubs 50 shown in FIG. 4A locks sizer tab to tab receiver 26 by locking into slot 26A formed on the outside of tab receiver 26.

Figure 2B:
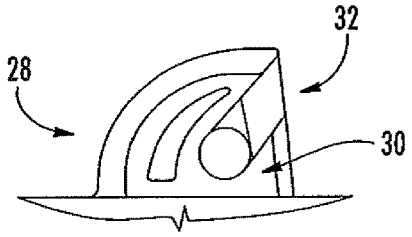
FIG. 2B is an enlarged front perspective view of the pivot structure enabling the hanger to rotate.
Figure 2A:
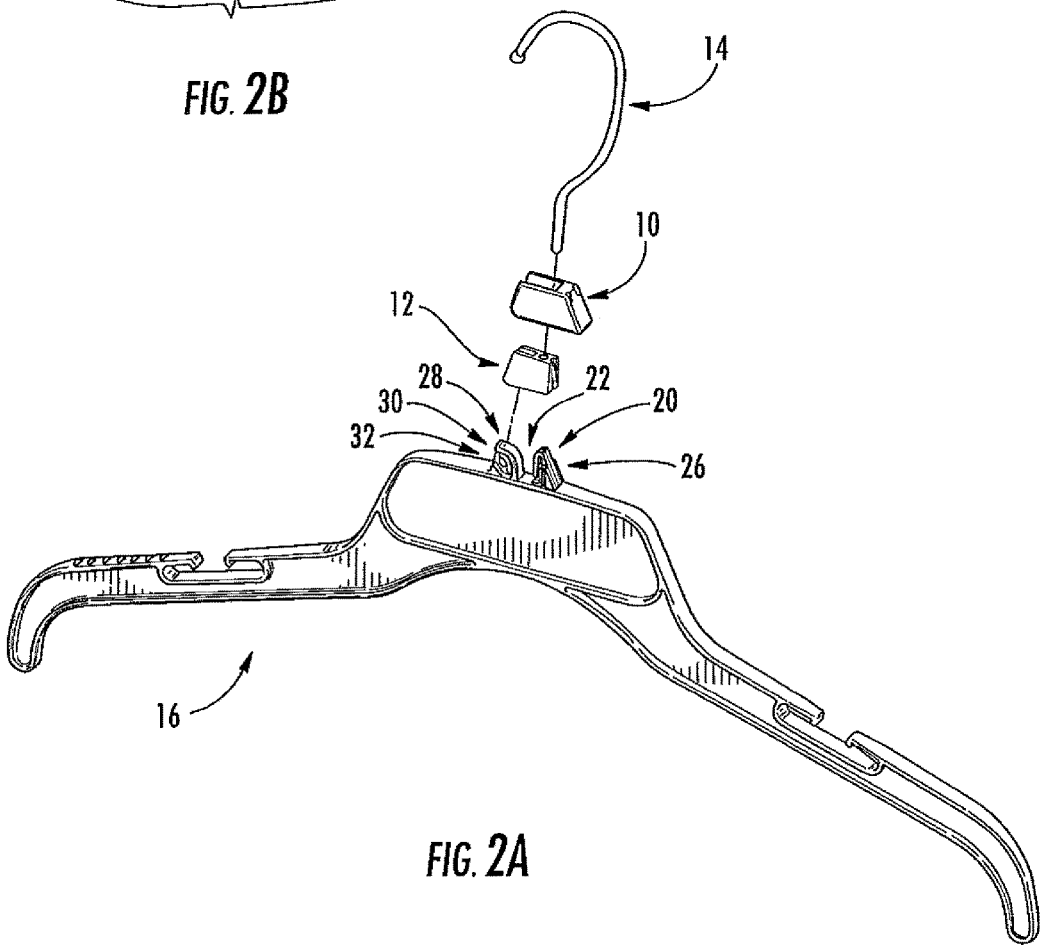
FIG. 2A is an exploded front perspective view of this invention.
Figure 2C:
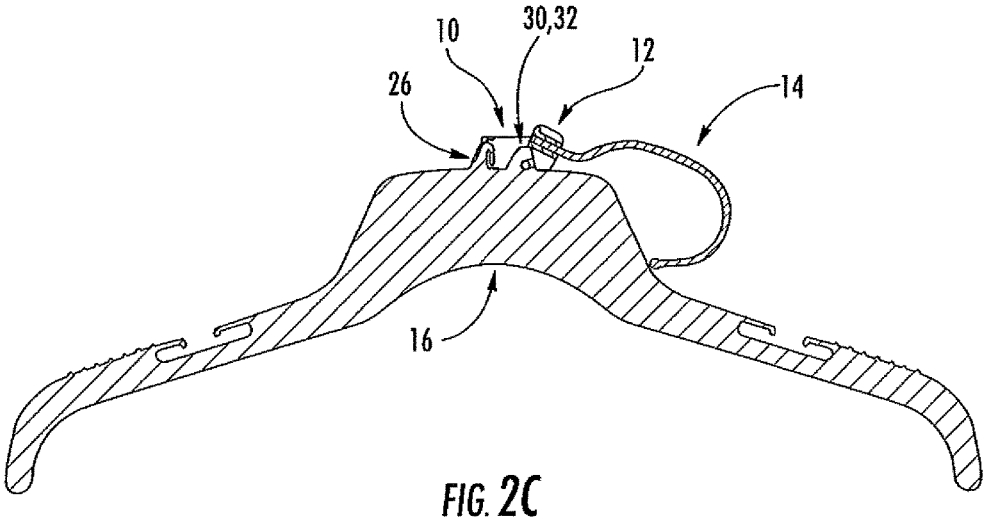
FIG. 2C is a sectional rear plan view of the hanger of this invention.
Figure 2D:
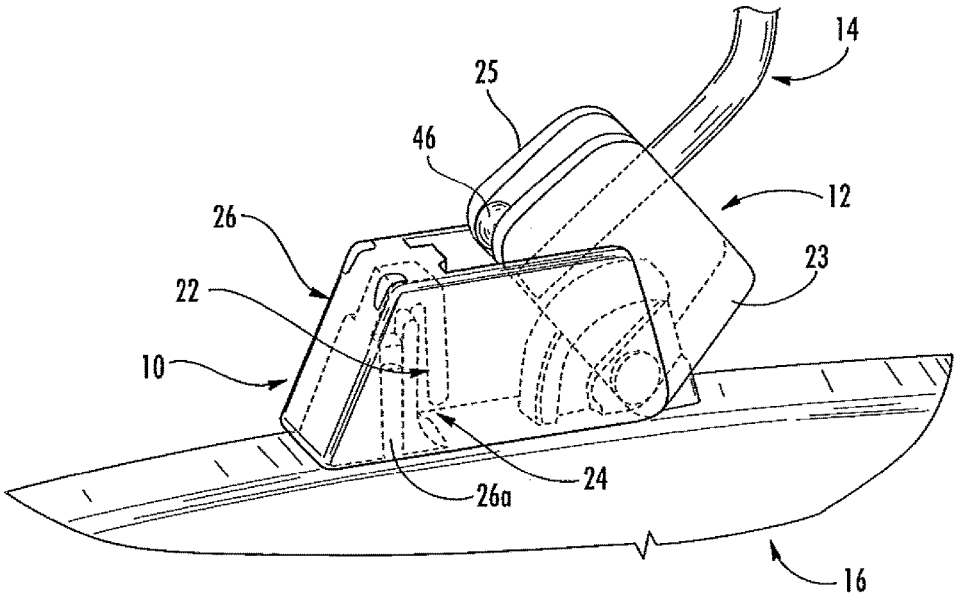
FIG. 2D is an enlarged perspective view of the hook attachment and locking pivot mount of this invention.

FIG. 2A-2C also shows pivot mount 28 which connects to hook attachment 12 as shown in FIGS. 2B-2D. Hook attachment 12 has a partial trapezoidal shape, two matching sides 23 and 25, a pivot 40/42 on one lower end and a locking lug 46 on the other lower end.

Figure 3C:
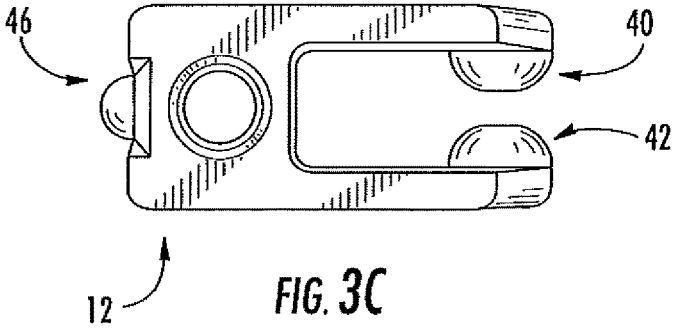
FIG. 3C is a top plan view of the hook attachment.

FIG. 3 shows three views of hook attachment 12. Hook attachment 12 has pivot pins 40 and 42 that lock into pivot mount 28 via tapered lead 32 using hole 30 for pivot 32 which is unitarily formed on top of hanger body 16 as shown in FIGS. 2A-2D.

Hook Attachment 12 rotates from vertical to horizontal positions engaging and disengaging flexible finger member 22 in FIG. 2 by utilizing locking lug 46 (see FIGS. 3A-3C) fitting under flexible finger 22. Prior to or after assembly, threaded or barbed metal hook 14 is inserted into hook attachment 12 through hole 44 (or a molded plastic hook can also be molded onto part 12 in place of a metal hook).

The simplicity of the movement of the hook allows the invention to be cost effective to manufacture, easy to assemble, and simple for pivoting and locking in upright position as seen in the Figures. More importantly, the solid block like partial trapezoidal structure for hook attachment 12 movable in hole 30 of the pivot is structurally strong, not susceptible to easy fracturing, and with flexible member or finger 22 bearing on nub 46, the structure of hook attachment 12 is secure and substantially unbreakable as is the holding of nub 46 by finger 22. Moving the hook 14 to its horizontal position involves forcing nub 46 out of engagement with finger 22. Note that the locking of nub 46 in and under finger 22 is in the same plane of movement as movable hook 14. This means that when it is desired to remove nub 46 from finger 22, the torque effect of moving the hook to effect engagement or disengagement between nub 46 and finger allows for less pressure to be applied when it is desired to move the hook. This contrasts with Ho in that one must first disengage ribs 36 from detents 38 by trying to separate them perpendicularly with respect to the plane of movement of hook 18 without having the benefit of the fulcrum or torque effect of the present invention. Ho requires greater force to effect disengagement and such greater force could damage the Ho hanger.

As discussed above, the folded state of the hanger provides a reduced footprint of the hanger creating space savings in packaging and transport. In order to save time and expense at the retail level, the garment is placed on the hanger at the point of garment manufacturing and placed into a shipping box or container. Upon delivery to the retailer location the retailer has to remove the "garment on hanger" from the box or container and hang it appropriately in a distribution center for e commerce shipment or further shipment to an individual store.

Figure 4A:
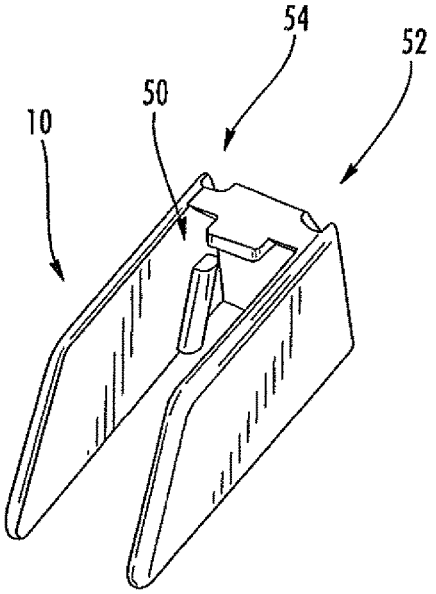
FIGS. 4A and 4B are left and right perspective views of the sizer tab of this invention.
Figure 4B:
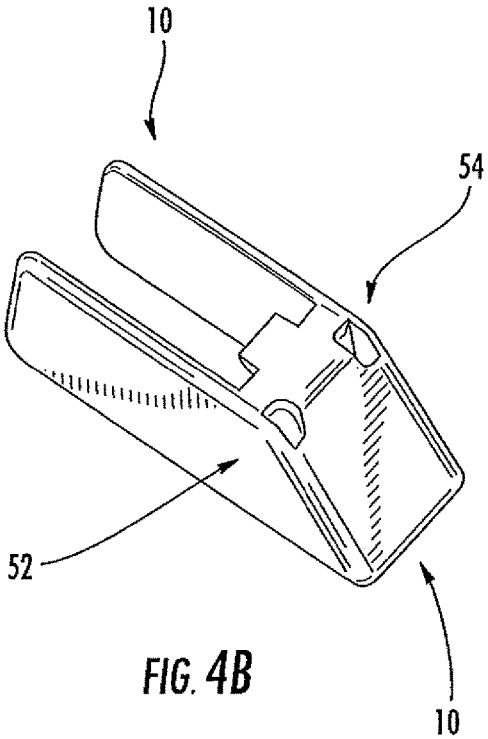

FIGS. 4A and 4B show an identity sizer tab 10 which is attached to locking mount 20 in FIG. 2. Size identity tab 10 locks into sizer tab receiver 26 in FIG. 2A with locking nubs 50. Right slot opening 52 and left slot opening 54 allow for metal cores in the production tool to form locking nubs 50 on the left and right inner sides of sizer identity tab 10. The three sided shape and open top of size identity tab 10, allows hook 14 to substantially pivot vertical to horizontal while being held firmly on the hook attachment 12. The locking nubs 50 on size tab 10 creates a system where the sizer tab 10 attaches to the hanger locking onto corresponding slots 26*a* on the outer side walls of size tab receiver 26. Removal is more difficult because locking nubs or ribs can be fixedly attached and caught by the slots. Child safety protection is thus provided. This allows for the size tab indicator to be attached onto the hook attachment 12 prior to garment hanging or shipping, again saving time and cost at the retail level or at a later time. The nature of any size identity tab is to allow for a garment that is hung on the hanger to have the size of that garment to be displayed from three directions on the hanger when hanging on display rack. Size Identity tab 10 has three flat printable surfaces which can be utilized for imprinting garment size identification.

Figure 5A:
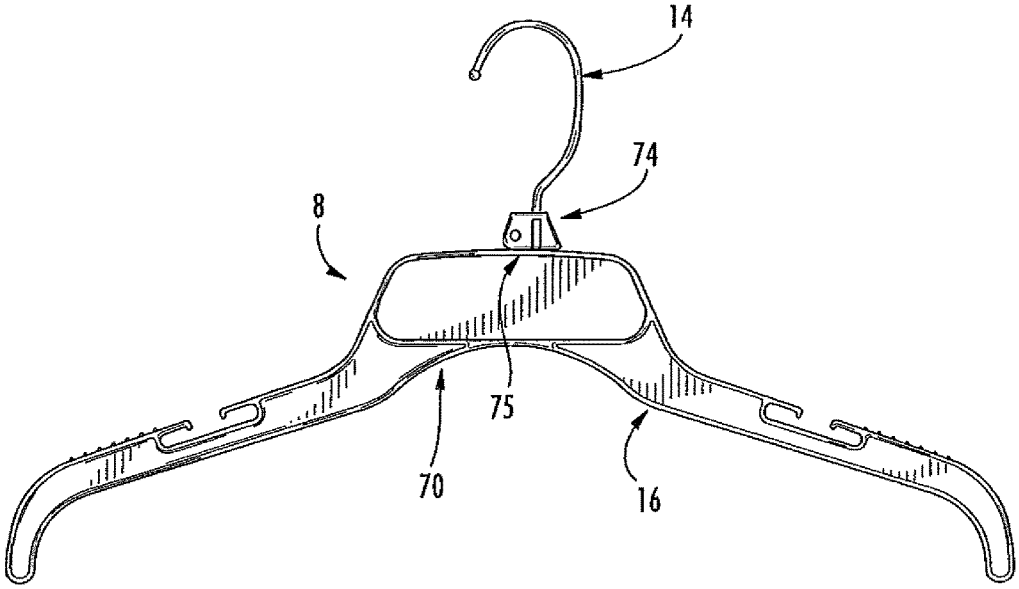
FIG. 5A is a rear plan view of a second embodiment of this invention.
Figure 5B:
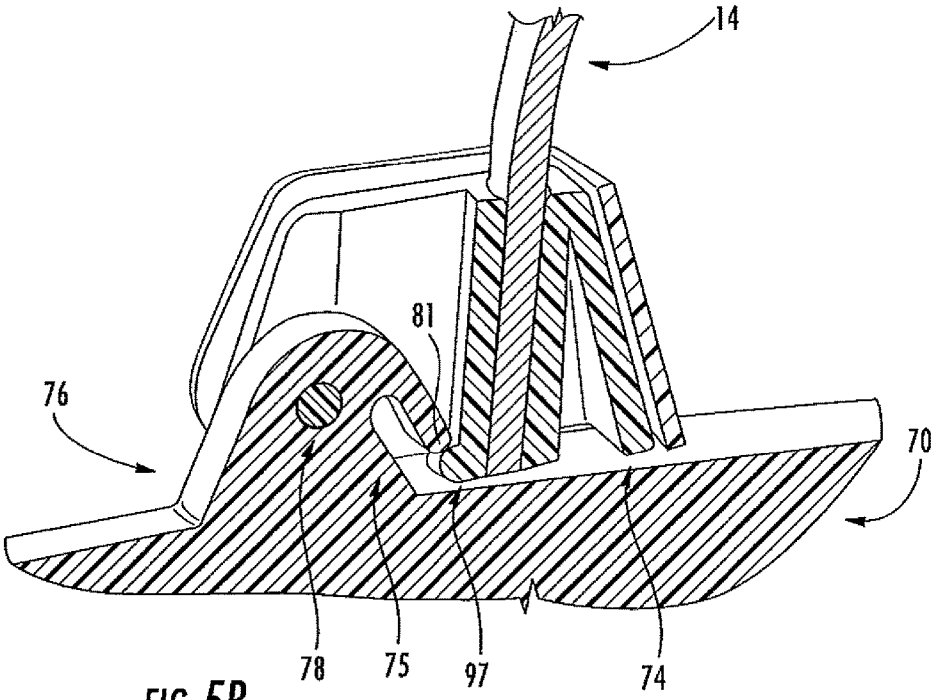
FIG. 5B is an enlarged partial sectional perspective view of the second embodiment of this invention.

FIGS. 5A-D shows a second embodiment of this invention. FIG. 5B illustrates this invention having a center mount member that consists of a hanger body 70 with a center pivot 76 and front and back pins 78 on center pivot 76. Center pivot is integrally formed with hanger body 70. Threaded or barbed metal hook 14 is inserted into beveled hole 90 of hook attachment 74.

Figure 5C:
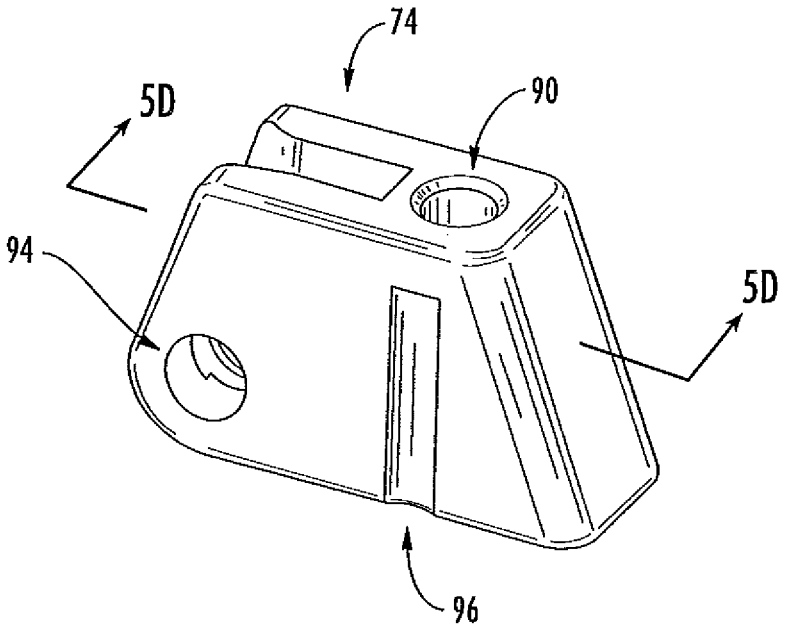
FIG. 5C is a right perspective view of a second embodiment of this invention for the hook attachment.
Figure 5D:
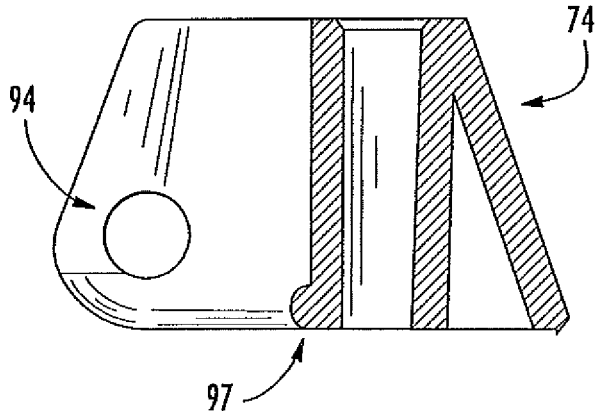
FIG. 5D is a sectional view of the second embodiment of the hook attachment of FIG. 5C.

Hook attachment center mount 74 is shown in detail in FIGS. 5C and 5D. Hook attachment center mount 74 has pivot holes 94 that lock onto pivot pins 78 and is held onto the hanger body 70 by center pivot 76 utilizing locking nub 97. Hook attachment center mount 74 rotates from vertical to horizontal positions engaging and disengaging with locking nub 97 which fits below and functionally engages flexible finger 81 formed as part of pivot 76. Flexible finger 81 resiliently is moved by the force of nub 97 to hold hook 14 vertically.

Two grooves 96 are molded in to the front and back of hook attachment 74 forming a lip that will allow locking of a size tab holder 72 onto hook attachment 74. The collapsible hook 14 has a locking mechanism that allows the hanger hook to remain upright (vertical) and locked into position or have hook 14 move nub 97 out of engagement with finger 81 to easily fold during transportation and shipping. The simplicity of the movement of the hook allows invention to be cost effective to manufacture, easy to assemble, and simple for pivoting and ticking in upright position as seen in FIG. 5A.

As per the first embodiment of this invention, the hook is disengaged from being held by flexible finger 81 by pushing the hook 14 in the desired position. The torque effect because the hook movement is in the same plane as the engaging disengaging mechanism allows for less force to be required to move the hook 14.

In this embodiment the pivot mount is the center pivot 75 and the locking mount includes flexible finger 81 which is part of an integral structure with center pivot 75 on top of hanger body 16.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

PARTS LIST OF REFERENCE NUMERALS

8 Hanger
10 Size identity tab
12 Hook attachment
14 Hook
16 Hanger body
20 Locking mount
22 Flexible finger member
24 Space under finger member 22
26 Size tab receiver
26*a* Slot for locking lug 50
28 Pivot Mount
30 Hole or opening for pivot
31 Pivot pin
32 Tapered lead in for pivot
40 Right pivot pins
42 Left pivot pin
44 Beveled hole for hook
46 Locking lug
50 Locking nub on size tab
52 Right slot opening on size tab
54 Left Slot Opening on size tab
70 Hanger body for center mount
74 Hook attachment c enter mount
75 Center pivot locking
lug receptacle
76 Center pivot
77 Tapered lead in
78 Front and back pins
in center pivot
81 Flexible finger
90 Beveled hole for hook center mount
94 Pivot hole center mount hook attachment (both sides)
96 Grooves
97 Locking nub on hook attachment 74

The invention claimed is:

1. A combination of a hanger having a hook pivotable and movable from horizontal to vertical positions and a hanger body, said combination connected together for shipment, said hook attached to a hook attachment, said hook being movable in a first plane, said hook attachment comprising a partial trapezoidal structure, said partial trapezoidal structure comprising opposite sides and having a pivot at one end between said opposite sides and a locking nub at the other end between said opposite sides, a finger locking member integrally formed with and on top of said hanger body, said locking member comprising a flexible finger, said locking nub of said hook attachment securely fits against said flexible finger and is removably held there against, said engagement of said locking nub and said flexible finger being said first plane, said hook moveable from said vertical to said horizontal position, and said locking nub moving out of engagement from said flexible finger responsive to force provided by said hook being movable to said horizontal position, wherein said torque force on the hanger is in said first plane, a pivot mount integrally formed with and on top of said hanger body, said pivot mount having a pivot opening, said hook attachment comprising pivot pins fitting into said pivot opening and pivoting therein, said hook moveable to said horizontal position to minimize the profile of said hanger with said hook.

2. A combination as in claim 1, wherein said pivot mount and said finger locking member are integrally formed as separate members on top of said hanger body.

3. A combination as in claim 1, further comprising a sizer tab fitting onto said hook attachment.

4. A combination as in claim 1, wherein said finger locking member and said pivot are integrally formed together and are integrally formed on top of said hanger body.

5. A combination as in claim 4, wherein said flexible finger terminates a distance from the top of said hanger body and said locking nub fits below and engages said flexible finger.

* * * * *